US011313076B2

(12) United States Patent
Matsumoto

(10) Patent No.: US 11,313,076 B2
(45) Date of Patent: Apr. 26, 2022

(54) TRANSFER PAPER

(71) Applicant: MITSUBISHI PAPER MILLS LIMITED, Tokyo (JP)

(72) Inventor: Shinichiro Matsumoto, Sumida-ku (JP)

(73) Assignee: MITSUBISHI PAPER MILLS LIMITED, Tokyo (JP)

( * ) Notice: Subject to any disclaimer, the term of this patent is extended or adjusted under 35 U.S.C. 154(b) by 223 days.

(21) Appl. No.: 16/558,813

(22) Filed: Sep. 3, 2019

(65) Prior Publication Data

US 2020/0080261 A1 Mar. 12, 2020

(30) Foreign Application Priority Data

Sep. 10, 2018 (JP) ..... JP2018-169096
Jun. 28, 2019 (JP) ..... JP2019-120635

(51) Int. Cl.
*D06P 5/28* (2006.01)
*B44C 1/17* (2006.01)

(52) U.S. Cl.
CPC ..... *D06P 5/005* (2013.01); *B44C 1/1712* (2013.01)

(58) Field of Classification Search
CPC ..... D06P 5/005; B44C 1/1712; B05D 6/14; B05D 7/56; B05D 2201/02; B05D 2201/00; B05D 2201/04; C09D 11/101
See application file for complete search history.

(56) References Cited

U.S. PATENT DOCUMENTS 4,090,887 A * 5/1978 Marquisee ..... C09B 67/006 106/409
5,064,735 A * 11/1991 Rampel ..... H01M 4/246 429/206
5,837,351 A * 11/1998 Chernovitz ..... B41M 5/52 428/32.31
6,277,498 B1 * 8/2001 Endo ..... B41M 5/5236 428/32.28
6,514,598 B1 * 2/2003 Totani ..... B41M 5/502 428/195.1
9,399,362 B1 7/2016 Cobb, III
2004/0241355 A1 * 12/2004 Yoshinari ..... B41C 1/1091 428/32.87
2007/0122726 A1 * 5/2007 Mizuhata ..... G03G 9/0833 430/106.1
2011/0223373 A1 * 9/2011 Abrams ..... B32B 27/322 428/90
2018/0171192 A1 * 6/2018 Abrams ..... B05D 1/14

FOREIGN PATENT DOCUMENTS

EP 2133464 12/2009
JP 2001068115 A * 3/2001
JP 2001-315440 11/2011
JP 2016-102283 6/2016
JP 5970588 7/2016

OTHER PUBLICATIONS

H&E, Polyamide Resin, Nov. 20, 2021 (Year: 2021).*

* cited by examiner

*Primary Examiner* — David H Banh
(74) *Attorney, Agent, or Firm* — Venable LLP

(57) ABSTRACT

An object of the present invention is to provide a transfer paper which allows smooth removal of a printed transfer paper from a design-printed fabric before steaming; and is unlikely to cause problems such as partial missing, color unevenness, color-development deterioration, etc. of the design on the fabric.

Provided is a transfer paper having a substrate and one or more coating layers, the substrate having a base paper and one or more nonaqueous resin layers on one side of the base paper, the one or more coating layers being located on the one or more nonaqueous resin layers, the coating layer located outermost from the substrate, that is, the outermost coating layer, at least comprising a water-soluble polyester resin, a carboxylic acid-modified polyvinyl alcohol resin, an acrylic resin, a starch, and a white pigment, the acrylic resin having a glass transition point (Tg) of 0° C. to 45° C. and a minimum film forming temperature (MFT) of 0° C. to 50° C.

6 Claims, No Drawings

TRANSFER PAPER

TECHNICAL FIELD

The present invention relates to a transfer paper for transfer of a design to a fabric. One embodiment of the present invention relates to a transfer paper used for transfer of a design printed with an acidic ink containing an acid dye to a nylon fabric.

BACKGROUND ART

A textile printing paper is required to achieve high-resolution depiction of a print design and high-degree level-dyeing without affecting soft texture of textiles in a repeatable manner. Known textile printing papers include a textile printing paper for use in a transfer printing method which comprises printing a design on a textile printing paper with a dye-containing ink to prepare a printed paper; bringing the printed paper into close contact with a textile or leather material and applying heat and pressure thereon for dye transfer; and performing dye fixing treatment in such a state that the printed paper is stuck to the textile or leather material, the textile printing paper having a base paper and an ink-receiving and adhesive layer absorbed in or layered on the base paper, the ink-receiving and adhesive layer being formed by subjecting the base paper to coating or spraying with, or dipping in a hydrophilic mixture containing a water-soluble synthetic binder, a natural glue and various auxiliary agents, followed by drying, wherein the proportion of the natural glue to the water-soluble synthetic binder is 5% to 0% in terms of solids content (for example, see Patent Literature 1).

CITATION LIST

Patent Literature

Patent Literature 1: JP-A 2016-102283

SUMMARY OF INVENTION

Technical Problem

Ordinary nylon fabric is generally resistant to heat at a temperature of 80° C. to 140° C. but may deform under heat when the temperature exceeds about 70° C. For this reason, nylon may cause problems when used as a textile material in a transfer printing method which comprises bringing a printed transfer paper into close contact with a textile material, applying heat and pressure thereon for dye transfer, and performing steaming for dye fixation in a state that the printed transfer paper is kept stuck to the textile material, as disclosed in Patent Literature 1.

More specifically, when steaming is performed in a state that a printed transfer paper is kept stuck to a nylon fabric, the dimensional stability of the nylon fabric against heat and the dimensional stability of the printed transfer paper against moisture cause operational problems such as partial detachment, partial blister, and partial wrinkling of the printed transfer paper stuck to the nylon fabric. This results in partial deterioration of image quality on the nylon fabric. Such problems have been addressed with steaming operator's skills or with the arrangement of design components on a confined area. In addition, the ink receiving and adhesive layer disclosed in Patent Literature 1 functions to adhere to a textile material under the application of heat and pressure, and this property makes it difficult to remove the printed transfer paper from the textile material at an economically satisfactory speed after application of heat and pressure and before steaming. Even when the printed transfer paper can be removed from the textile material, problems may arise such as partial missing, color unevenness, color-development deterioration, etc. of the design on the nylon fabric.

The present invention is intended to solve such operational problems including partial detachment, partial blister, and partial wrinkling of the printed transfer paper, and an object of the present invention is to provide a transfer paper which enables the formation of a design on a fabric, in particular, a nylon fabric by bringing a printed transfer paper into close contact with the nylon fabric and applying heat and pressure thereon; allows smooth removal of the printed transfer paper from the nylon fabric after design formation and before steaming; and is unlikely to cause problems such as partial missing, color unevenness, color-development deterioration, etc. of the design on the nylon fabric.

Solution to Problem

The present inventor conducted intensive research to achieve the above-mentioned object. As a result, the present inventor found that the object of the present invention can be achieved by the following.

[1] A transfer paper which is for use in a transfer printing method and is yet to be subjected to printing of a design, the transfer printing method comprising printing the design with a dye ink to prepare a printed transfer paper; bringing the printed transfer paper into close contact with a fabric and applying heat and pressure thereon to transfer the dye on the printed transfer paper to the fabric; removing the printed transfer paper from the fabric; and steaming the fabric, the transfer paper having a substrate and one or more coating layers, the substrate having a base paper and one or more nonaqueous resin layers on one side of the base paper, the one or more coating layers being located on the one or more nonaqueous resin layers, the coating layer located outermost from the substrate, that is, the outermost coating layer, at least comprising a water-soluble polyester resin, a carboxylic acid-modified polyvinyl alcohol resin, an acrylic resin, a starch, and a white pigment, the acrylic resin having a glass transition point (Tg) of 0° C. to 45° C. and a minimum film forming temperature (MFT) of 0° C. to 50° C.

This transfer paper enables the formation of a design on a fabric by printing the design on the transfer paper to prepare a printed transfer paper, bringing the printed transfer paper into close contact with the fabric and applying heat and pressure thereon; allows smooth removal of the printed transfer paper from the fabric after design formation and before steaming; and is unlikely to cause problems such as partial missing, color unevenness, color-development deterioration, etc. of the design on the fabric.

[2] In at least one embodiment, provided is the transfer paper according to the above [1] , wherein the white pigment at least comprises an amorphous silica, and wherein the amorphous silica has a volume-based average particle diameter of 27 μm to 40 μm as determined by laser diffraction/scattering particle size distribution measurement.

This transfer paper is advantageous in that the removability of the printed transfer paper from a fabric is improved.

[3] In at least one embodiment, provided is the transfer paper according to the above [2], wherein the amorphous silica has a ratio of D80 to D20 (D80/D20) of 2.9 to 4.5 as determined by laser diffraction/scattering particle size distribution measurement, wherein D20 represents a particle diameter at a cumulative frequency of 20% from a starting point where a particle diameter is zero in a volume-based particle size distribution curve which plots the diameter of particles on the horizontal axis and the frequency of particles on the vertical axis, and wherein D80 represents a particle diameter at a cumulative frequency of 80% from a starting point where a particle diameter is zero in the volume-based particle size distribution curve which plots the diameter of particles on the horizontal axis and the frequency of particles on the vertical axis.

This transfer paper is advantageous in that problems such as partial missing, color unevenness, color-development deterioration, etc. of the design on the nylon fabric are unlikely to occur, and/or that the removability of the printed transfer paper from the fabric is improved.

At least one embodiment is a transfer paper used in a transfer printing method using a nylon fabric as a fabric and an acidic ink containing an acid dye as a dye ink.

Advantageous Effects of Invention

The present invention provides a transfer paper which enables the formation of a design on a fabric by bringing a printed transfer paper into close contact with the fabric and applying heat and pressure thereon; allows smooth removal of the printed transfer paper from the fabric after design formation and before steaming; and is unlikely to cause problems such as partial missing, color unevenness, color-development deterioration, etc. of the design on the fabric.

DESCRIPTION OF EMBODIMENTS

Hereinafter, the present invention will be described in detail.

In the present invention, the "transfer paper" refers to a blank sheet of paper which is yet to be subjected to printing of a design to be transferred. The "printed transfer paper" refers to a printed sheet of paper, more specifically a transfer paper having been subjected to printing of a design to be transferred.

In the present invention, "having a coating layer" means having a coating layer that can be clearly distinguished from a substrate by electron microscopy of the cross-section of a transfer paper. For example, when a small amount of a resin component or a polymer component is applied for coating, the component may be absorbed into a substrate and thus not form a coating layer that can be clearly distinguished from the substrate by electron microscopy of the cross-section of the transfer paper. In this case, the transfer paper is not regarded as "having a coating layer".

The transfer paper has a substrate and one or more coating layers, the substrate having a base paper and one or more nonaqueous resin layers on one side of the base paper, the one or more coating layers being located on the one or more nonaqueous resin layers. Among the coating layers, the coating layer located outermost from the substrate is called the outermost coating layer. In the case where the transfer paper has a single coating layer, this coating layer is the outermost coating layer. The outermost coating layer at least comprises a water-soluble polyester resin, a carboxylic acid-modified polyvinyl alcohol resin, an acrylic resin, a starch, and a white pigment. In the case where the transfer paper has two or more coating layers, one or more coating layers located between the substrate and the outermost coating layer are known coating layers used in the coated paper field, and there is no particular limitation on the presence or absence or the type of the white pigment or the presence or absence or the type of the resin. The one or more coating layers located between the substrate and the outermost coating layer can comprise various known additives used in the coated paper field.

In view of production cost, it is preferable that the transfer paper has a single coating layer. The coating layer is provided on the nonaqueous resin layer side of the substrate. The transfer paper may have a known backcoat layer on the back side of the substrate, namely, on the opposite side of the base paper from the nonaqueous resin layer.

The coating weight of the coating layer is not particularly limited. In view of the production cost of the transfer paper and ease of handling, it is preferable that the coating weight per one side is from 5 g/m$^2$ to 70 g/m$^2$ in terms of dry solids content. The coating weight per one side is more preferably 30 g/m$^2$ or less in terms of dry solids content. Moreover, for reduction of production cost and prevention of partial fall-off of the coating layer due to close contact of the printed transfer paper with the fabric, the coating weight per one side is most preferably from 10 g/m$^2$ to 30 g/m$^2$ in terms of dry solids content. In the case where two or more coating layers are present per one side, the coating weight is the total coating weight of the two or more coating layers.

The base paper is usually a paper produced by subjecting, to a papermaking process, a paper stock containing at least one kind of pulp selected from a chemical pulp such as LBKP (Leaf Bleached Kraft Pulp) and NBKP (Needle Bleached Kraft Pulp), a mechanical pulp such as GP (Groundwood Pulp), PGW (Pressure GroundWood pulp), RMP (Refiner Mechanical Pulp), TMP (ThermoMechanical Pulp), CTMP (ChemiThermoMechanical Pulp), CMP (ChemiMechanical Pulp), and CGP (ChemiGroundwood Pulp), and a waste paper pulp such as DIP (Delnked Pulp); a filler such as ground calcium carbonate, precipitated calcium carbonate, talc, clay, kaolin, and calcined kaolin; and as needed, an additive such as a sizing agent, a fixing agent, a retention aid, a cationizing agent, and a paper strengthening agent. The base paper may also be, for example, a woodfree paper prepared by papermaking, followed by calendering, surface sizing with starch, polyvinyl alcohol, or the like, surface treatment or other treatments. Further, the base paper may also be a woodfree paper prepared by papermaking and surface sizing or surface treatment, followed by calendering.

Papermaking is performed using a known paper machine after rendering a paper stock acidic, neutral, or alkaline. Examples of the paper machine include a Fourdrinier paper machine, a twin-wire paper machine, a combination paper machine, a cylinder paper machine, and a Yankee paper machine.

The basis weight of the base paper is not particularly limited. For easy handling of papers, the basis weight of the base paper is preferably from 10 g/m$^2$ to 100 g/m$^2$, and more preferably from 30 g/m$^2$ to 100 g/m$^2$.

The paper stock can contain one or more additional additives selected from a binder, a pigment dispersant, a thickener, a glidant, a defoamer, an antifoamer, a release agent, a foaming agent, a penetrant, a coloring dye, a coloring pigment, an optical brightener, an ultraviolet absorber, an antioxidant, a preservative, a fungicide, an insolubilizer, a wet strengthening agent, a dry strengthening agent, etc. as long as the one or more additional additives do not impair the effects of the present invention.

The substrate can be obtained by forming a nonaqueous resin layer on one side of the base paper. The nonaqueous resin layer functions to help removal of a printed transfer paper from a fabric and to prevent penetration of a dye ink into the base paper. When the printed transfer paper is removed from the fabric, if it is difficult to separate the coating layer of the printed transfer paper from the fabric, the whole or some of coating layers are detached from the nonaqueous resin layer in the printed transfer paper and remain on the fabric, and the printed transfer paper can be successfully removed. In the case of a transfer printing method which comprises steaming the fabric removed from the printed transfer paper, operational problems including partial detachment, partial blister, and partial wrinkling of the printed transfer paper can be prevented from occurring. Moreover, in the case of printing a design on a transfer paper with a dye ink, the nonaqueous resin layer prevents penetration of the dye into the base paper, and thus problems such as partial missing, color unevenness, color-development deterioration, etc. of the design on the fabric are further unlikely to occur.

The nonaqueous resin layer is a water-insoluble layer formed from a nonaqueous resin. One type of nonaqueous resin which forms the nonaqueous resin layer is a resin compatible with a medium which is a non-water solvent. The resin compatible with a medium which is a non-water solvent can be a solvent-borne resin. Another type of nonaqueous resin which forms the nonaqueous resin layer is a solventless resin. Yet another type of nonaqueous resin which forms the nonaqueous resin layer is an emulsion-type resin. Examples of the nonaqueous resin include polyolefin resins, vinyl resins, and electron beam curable resins. Specific examples of the nonaqueous resin include polyethylenes such as a high-density polyethylene, a low-density polyethylene, a medium-density polyethylene, and a linear low-density polyethylene; and polypropylenes such as an isotactic polypropylene, a syndiotactic polypropylene, an atactic polypropylene, and a mixture thereof, a random copolymer of polypropylene with ethylene, and a block copolymer of polypropylene with ethylene. In addition, polymethyl pentene, polyethylene glycol terephthalate, polyvinyl chloride, polyvinylidene chloride, an ethylene-vinyl alcohol copolymer, an ethylene-vinyl acetate copolymer, etc. are also included. The nonaqueous resin maybe one kind or a combination of two or more kinds selected from the group consisting of the foregoing examples.

The method for forming the nonaqueous resin layer in the substrate is not particularly limited. In the case of a solventless resin, the nonaqueous resin layer can be formed using, for example, a known laminator, such as an ordinary melt extrusion die, a T-die, or a multilayer coextrusion die. In the case of a solvent-borne resin, the nonaqueous resin layer can be formed by, for example, coating and drying of a nonaqueous resin layer coating composition containing the nonaqueous resin dissolved in a solvent as a medium. In the case of an emulsion-type resin, the nonaqueous resin layer can be formed by, for example, coating and drying of a nonaqueous resin layer coating composition containing an emulsion of the nonaqueous resin and a water as a medium. The method for coating and drying of the nonaqueous resin layer coating composition is not particularly limited. Coating and drying can be performed using, for example, a known coater and a known dryer used in the papermaking field. Examples of the coater include a size press coater, a gate roll coater, a film transfer coater, a blade coater, a rod coater, an air knife coater, a comma coater, a gravure coater, a bar coater, an extrusion bar coater, and a curtain coater. Examples of the dryer include hot air dryers such as a linear tunnel dryer, an arch dryer, an air loop dryer, and a sine curve air floatation dryer; an infrared heat dryer; and a microwave dryer.

One or more nonaqueous resin layers are provided on one side of the base paper. In view of production cost, it is preferable that a single nonaqueous resin layer is provided on one side of the base paper. The thickness of the nonaqueous resin layer is preferably 10 μm or more, and more preferably 15 μm or more. In this case, the nonaqueous resin layer sufficiently covers the base paper and the functions of the nonaqueous resin layer described above are improved. In addition, the thickness of the nonaqueous resin layer is preferably 30 μm or less. This is because the material cost will increase at a thickness of more than 30 μm although the functions described above are saturated at 30 μm.

The thickness of the nonaqueous resin layer consisting of a single layer represents the thickness of the single nonaqueous resin layer. The thickness of the nonaqueous resin layer consisting of two or more layers represents the total thickness of the two or more nonaqueous resin layers.

The coating layer can be formed by coating and drying of a coating layer coating composition on the substrate or the underlying coating layer.

The method for forming the coating layer is not particularly limited. Coating and drying can be performed using, for example, a known coater and a known dryer used in the papermaking field. Examples of the coater include a size press coater, a gate roll coater, a film transfer coater, a blade coater, a rod coater, an air knife coater, a comma coater, a gravure coater, a bar coater, an extrusion bar coater, and a curtain coater. Examples of the dryer include hot air dryers such as a linear tunnel dryer, an arch dryer, an air loop dryer, and a sine curve air floatation dryer; an infrared heat dryer; and a microwave dryer.

The coating layer can be subjected to calendering after coating and drying.

The outermost coating layer at least comprises a water-soluble polyester resin, a carboxylic acid-modified polyvinyl alcohol resin, an acrylic resin, a starch, and a white pigment. The outermost coating layer comprising a water-soluble polyester resin, a carboxylic acid-modified polyvinyl alcohol resin, an acrylic resin, a starch, and a white pigment can be formed from an outermost coating layer coating composition containing the water-soluble polyester resin, the carboxylic acid-modified polyvinyl alcohol resin, the acrylic resin, the starch, and the white pigment.

The water-soluble polyester resin is a resin that can be obtained by polycondensation of a polycarboxylic acid and a polyol, the total of which accounts for 60% by mass or more of the components of the resin.

Examples of the polycarboxylic acid include terephthalic acid, isophthalic acid, phthalic acid, naphthalene dicarboxylic acid, adipic acid, succinic acid, sebacic acid, and dodecanedioic acid. Preferably, one or more kinds selected from the group consisting of the foregoing examples are used. Examples of the polyol include ethylene glycol, propylene glycol, 1,4-butanediol, 1,6-hexanediol, neopentylglycol, diethylene glycol, dipropylene glycol, cyclohexanedimethanol, and bisphenol. Preferably, one or more kinds selected from the group consisting of the foregoing examples are used. The water-soluble polyester resin may be copolymerized with a component having a hydrophilic group such as a carboxyl group or a sulfonic group for further improvement of water solubility. Water-soluble polyester resins are commercially available from Goo Chemical Co., Ltd., Takamatsu Oil & Fat Co., Ltd., Unitika Ltd., etc., and such commercial products can be used in the present invention. The term "water-soluble" means that 1% by mass or more of a solute can be ultimately dissolved in water at 20° C.

The carboxylic acid-modified polyvinyl alcohol resin has a carboxylic acid-modified polyvinyl-alcohol moiety formed by introduction of a carboxyl group.

Examples of the carboxylic acid-modified polyvinyl alcohol resin include carboxylic acid-modified polyvinyl alcohol resins obtained by graft copolymerization or block copolymerization of polyvinyl alcohol and a vinyl carboxylic acid compound; carboxylic acid-modified polyvinyl alcohol resins obtained by copolymerization of a vinyl ester compound and a vinyl carboxylic acid compound, followed by saponification; and carboxylic acid-modified polyvinyl alcohol resins obtained by reaction of polyvinyl alcohol with a carboxylating agent. Examples of the vinyl carboxylic acid compound include carboxyl group-containing compounds and anhydrides thereof, such as acrylic acid, methacrylic acid, maleic acid (maleic anhydride), phthalic acid (phthalic anhydride), itaconic acid (itaconic anhydride), and trimellitic acid (trimellitic anhydride). Examples of the vinyl ester compound include vinyl acetate, vinyl formate, vinyl propionate, vinyl versatate, and vinyl pivalate. Examples of the carboxylating agent include succinic anhydride, maleic anhydride, acetic anhydride, trimellitic anhydride, phthalic anhydride, pyromellitic dianhydride, glutaric anhydride, hydrogenated phthalic anhydride, and naphthalene dicarboxylic anhydride. Carboxylic acid-modified polyvinyl alcohols are commercially available from Mitsubishi Chemical Corporation, JAPAN VAM & POVAL CO., LTD., Kuraray Co., Ltd., etc., and such commercial products can be used in the present invention.

The number-average polymerization degree and the saponification degree of the carboxylic acid-modified polyvinyl alcohol resin are not particularly limited. Regarding the saponification degree of the carboxylic acid-modified polyvinyl alcohol resin, partial saponification is preferable, and the saponification degree is preferably from 85 mol % to 90 mol %. In this case, the removability of the printed transfer paper from the fabric is improved, or problems such as partial missing, color unevenness, color-development deterioration, etc. of the design on the fabric are further unlikely to occur.

Acrylic resin is a generic term for polymers or copolymers having, as a main component, acrylic acid and a derivative thereof such as an ester thereof, and methacrylic acid and a derivative thereof such as an ester thereof. The "main component" in this context means that acrylic acid and a derivative thereof such as an ester thereof, and methacrylic acid and a derivative thereof such as an ester thereof account for 51% by mass or more of the whole resin. Examples of the acrylate ester include methyl acrylate, ethyl acrylate, butyl acrylate, ethyl hexyl acrylate, 2-dimethylaminoethyl acrylate, and 2-hydroxyethyl acrylate. Examples of the methacrylate ester include methyl methacrylate, ethyl methacrylate, butyl methacrylate, ethyl hexyl methacrylate, 2-dimethylaminoethyl methacrylate, and 2-hydroxyethyl methacrylate. In the present invention, copolymers, such as acrylonitrile, acrylamide, and N-methylolacrylamide, are also encompassed in the acrylic resin.

Acrylic resins are commercially available from Toagosei Co., Ltd., NIPPON SHOKUBAI Co., Ltd., Japan Coating Resin Co., Ltd., Idemitsu Kosan Co., Ltd., Mitsubishi Chemical Corporation, etc., and such commercial products can be used in the present invention.

The acrylic resin has a glass transition point (Tg) of 0° C. to 45° C. In addition, the acrylic resin has a minimum film forming temperature (MFT) of 0° C. to 50° C. In the case where the physical property values of the acrylic resin fall outside the above ranges, the printed transfer paper cannot be removed from the fabric at an economically satisfactory speed, or problems such as partial missing, color unevenness, and color-development deterioration of the design on the fabric are unpreventable.

The glass transition point (Tg) of the acrylic resin can be adjusted by selecting the mass proportion of each monomer in an individual acrylic resin etc. based on the Fox Equation given below.

Fox Equation $$1/Tg=(W1/Tg1)+(W2/Tg2)+\ldots+(Wm/Tgm)$$

$$W1+W2+\ldots+Wm=1$$

In the formula, Tg represents the glass transition point of the acrylic resin; Tg1, Tg2, . . . , or Tgm represents the glass transition point of a homopolymer produced from each monomer; and W1, W2, . . . , or Wm represents the mass proportion of each monomer.

The glass transition point of a homopolymer produced from each monomer used in the Fox Equation may be a value described in Polymer Handbook Third Edition (Wiley-Interscience, 1989). The glass transition point can be determined from measurement using a differential scanning calorimeter, for example, EXSTAR 6000 (manufactured by Seiko Instruments Inc.), DSC220C (manufactured by Seiko Instruments Inc.), DSC-7 (manufactured by PerkinElmer, Inc.), or the like, and is defined as the intersection of the baseline and the slope of the endothermic peak.

The minimum film forming temperature (MFT) refers to a minimum temperature required for thermoplastic resin particles to bind together and form a membrane. The MFT can be determined by a method using a temperature gradient plate as described in "Chemistry of Polymer Latex" authored by Soichi Muroi (published by the Polymer Publishing Association, 1987) etc. The method using a temperature gradient plate is described in ISO 2115: 1996 Plastics—Polymer dispersions—Determination of white point temperature and minimum film-forming temperature.

The starch includes polysaccharides formed by polymerization of glucose units via glycosidic bonds; and modified forms of such polysaccharides in which hydroxyl groups of the glucose units are modified with various substituting groups. Examples of the starch include starch, oxidized starch, enzymatically modified starch, etherified starch, cationic starch, amphoteric starch, dialdehyde starch, esterified starch, such as starch phosphate and starch urea phosphate, hydroxyethyl starch, hydroxypropyl starch, and hydroxybutyl starch.

Preferable amounts of the water-soluble polyester resin, the carboxylic acid-modified polyvinyl alcohol resin, the acrylic resin, and the starch in the outermost coating layer areas follows. The amount of the water-soluble polyester resin is from 25 parts by mass to 75 parts by mass, the amount of the acrylic resin is from 25 parts by mass to 75 parts by mass, and the amount of the starch is from 100 parts by mass to 200 parts by mass relative to 100 parts by mass of the carboxylic acid-modified polyvinyl alcohol resin in terms of dry solids content.

The outermost coating layer can comprise a known binder used in the coated paper field in addition to the water-soluble polyester resin, the carboxylic acid-modified polyvinyl alcohol resin, the acrylic resin, and the starch. The binder includes, for example, water-soluble synthetic resins, waterdispersible synthetic resins, naturally occurring resins, and physically- or chemically-modified forms thereof. Specific examples of the binder include a polyvinyl alcohol resin and various modified derivatives thereof excluding a carboxylic acid-modified polyvinyl alcohol resin; a urethane resin; a polyamide resin; a vinyl acetate resin; a styrene-butadiene copolymer resin; a polyester resin excluding a water-soluble polyester resin; a polyvinyl acetal resin; protein; casein; gelatin; gums, such as etherified tamarind gum, etherified locust bean gum, etherified guar gum, and acacia gum (gum arabic) ; cellulose and modified derivatives of cellulose, such as carboxymethyl cellulose and hydroxyethyl cellulose; and polysaccharides other than starch, such as sodium alginate.

The total amount of the water-soluble polyester resin, the carboxylic acid-modified polyvinyl alcohol resin, the acrylic resin, and the starch in the outermost coating layer is preferably 85% by mass or more relative to the amount of the binder (including the water-soluble polyester resin, the carboxylic acid-modified polyvinyl alcohol resin, the acrylic resin, and the starch) in the outermost coating layer.

The white pigment is a known white pigment used in the coated paper field. Examples of the white pigment include inorganic white pigments, such as ground calcium carbonate, precipitated calcium carbonate, various types of kaolin, clay, talc, calcium sulfate, barium sulfate, titanium dioxide, zinc oxide, zinc sulfide, zinc carbonate, satin white, aluminum silicate, diatomite, calcium silicate, magnesium silicate, amorphous silica, colloidal silica, aluminum hydroxide, alumina, hydrated alumina, lithopone, zeolite, magnesium carbonate, and magnesium hydroxide; and organic white pigments, such as a styrene plastic pigment, an acrylic plastic pigment, a styrene-acrylic plastic pigment, polyethylene, microcapsules, a urea resin, and a melamine resin.

The white pigment in the outermost coating layer preferably at least comprises an amorphous silica. Amorphous silicas can be roughly classified as a wet silica or a fumed silica according to the production process. Wet silicas can be further classified as a precipitated silica or a gel silica according to the production method. For production of a precipitated silica, sodium silicate is reacted with sulfuric acid under alkaline conditions, during which silica particles grow larger, aggregate and then precipitate. Subsequently, filtration, water washing, drying, pulverization, and classification are performed to obtain a precipitated silica. Precipitated silicas are commercially available as, for example, Nipsil (registered trademark) from. Tosoh Silica Corporation; FINESIL (registered trademark) and TOKUSIL (registered trademark) from Oriental Silicas Corporation (OSC); MIZUKASIL (registered trademark) from Mizusawa Industrial Chemicals, Ltd.; and silica gel from TOYOTAKAKO Co., Ltd. Gel silicas are produced by reacting sodium silicate with sulfuric acid under acidic conditions. Silica fine particles dissolve during aging, and then re-precipitate such that primary particles aggregate. Therefore, in gel silicas, clear primary particles are not observed, and relatively hard aggregate particles with an internal porous structure are formed. Gel silicas are commercially available as, for example, NIPGEL (registered trademark) from Tosoh Silica Corporation; and SYLOID (registered trademark) and SYLOJET (registered trademark) from Grace Japan. A fumed process is also called a dry process as contrasted to a wet process. Fumed silicas are generally produced by flame hydrolysis. More specifically, a method in which silicon tetrachloride is combusted together with hydrogen and oxygen is generally known. Silanes, such as methyltrichlorosilane and trichlorosilane, can be used alone instead of silicon tetrachloride or in combination with silicon tetrachloride. Fumed silicas are commercially available as, for example, AEROSIL (registered trademark) from Nippon Aerosil Co., Ltd. and REOLOSIL (registered trademark) from Tokuyama Corporation. The amorphous silica is preferably a precipitated silica.

In at least one embodiment, the amorphous silica contains relatively large particles of 10 μm or more in particle diameter. In this case, the printed transfer paper moderately adheres to the fabric, and the removability of the printed transfer paper from the fabric is improved. The amorphous silica preferably has a volume-based average particle diameter of 6.6 μm to 41 μm as determined by laser diffraction/scattering particle size distribution measurement. More preferably, the amorphous silica has a volume-based average particle diameter of 19 μm to 41 μm. Still more preferably, the amorphous silica has a volume-based average particle diameter of 27 μm to 40 μm. Most preferably, the amorphous silica has a volume-based average particle diameter of 27 μm to 37 μm. When the average particle diameter is in this range, the removability of the printed transfer paper from the fabric is improved.

In at least one embodiment, the amorphous silica has a moderate width of the particle size distribution. More specifically, the amorphous silica has a ratio of D80 to D20 (D80/D20) of 2.5 to 5.5 as determined by laser diffraction/scattering particle size distribution measurement. Here, D20 represents a particle diameter at a cumulative frequency of 20% from a starting point where a particle diameter is zero in a volume-based particle size distribution curve which plots the diameter of particles on the horizontal axis and the frequency of particles on the vertical axis, and D80 represents a particle diameter at a cumulative frequency of 80% from a starting point where a particle diameter is zero in the volume-based particle size distribution curve which plots the diameter of particles on the horizontal axis and the frequency of particles on the vertical axis. Preferably, the ratio D80 to D20 (D80/D20) is from 2.9 to 4.5. More preferably, the ratio D80 to D20 (D80/D20) is from 3.2 to 4.3. When the ratio D80 to D20 (D80/D20) is in this range, problems such as partial missing, color unevenness, color-development deterioration, etc. of the design on the nylon fabric is unlikely to occur, and/or the removability of the printed transfer paper from the fabric is improved.

The volume-based average particle diameter, D20, and D80 determined by a laser diffraction/scattering particle size distribution analysis can be measured and calculated with, for example, the laser diffraction/scattering particle size distribution analysis system Microtrac MT3000II manufactured by Nikkiso Co., Ltd. As defined above, D20 represents a particle diameter at a cumulative frequency of 20% from a starting point where a particle diameter is zero in a volume-based particle size distribution curve which plots the diameter of particles on the horizontal axis and the frequency of particles on the vertical axis, and D80 represents a particle diameter at a cumulative frequency of 80% from a starting point where a particle diameter is zero in the volume-based particle size distribution curve which plots the diameter of particles on the horizontal axis and the frequency of particles on the vertical axis.

The amorphous silica which satisfies the specified requirements for the average particle diameter and/or the ratio D80 to D20 (D80/D20) can be obtained by, for example, pulverization and particle size adjustment of an amorphous silica having relatively large particles. Alternatively, the desired amorphous silica can also be obtained by mixing an amorphous silica having a relatively small average particle diameter and an amorphous silica having a relatively large average particle diameter. Alternatively, commercial products which satisfy the specified requirements for the average particle diameter and/or the ratio D80 to D20 (D80/D20) can also be used as the amorphous silica.

The amount of the white pigment in the outermost coating layer is preferably from 15 parts by mass to 40 parts by mass relative to 100 parts by mass of the carboxylic acid-modified polyvinyl alcohol resin in terms of dry solids content.

The outermost coating layer, which comprises a water-soluble polyester resin, a carboxylic acid-modified polyvinyl alcohol resin, an acrylic resin having a Tg of 0° C. to 45° C. and an MFT of 0° C. to 50° C., a starch, and a white pigment, adheres moderately to a fabric as well as is smoothly removable from the fabric, and favorably receives a dye ink in printing as well as releases the dye ink in transfer. As a result, the outermost coating layer is unlikely to cause problems such as partial missing, color unevenness, color-development deterioration, etc. of the design on the fabric.

The outermost coating layer can comprise various known additives used in the coated paper field as needed, in addition to the water-soluble polyester resin, the carboxylic acid-modified polyvinyl alcohol resin, the acrylic resin, the starch, and the white pigment. Examples of the additive include a dispersant, a fixing agent, a cationizing agent, a thickener, a glidant, a defoamer, a release agent, a foaming agent, a penetrant, a colorant, an optical brightener, an ultraviolet absorber, an antioxidant, a preservative, and a fungicide.

In addition, the outermost coating layer can comprise various known auxiliary agents used in the transfer printing method. The auxiliary agent is added, for example, to optimize the physical properties of the outermost coating layer coating composition or to enhance the color yield of the dye to be transferred to a fabric. Examples of the auxiliary agent include various types of surfactants, pH adjusters, alkaline chemicals, color deepening agents, degassing agents, and reduction inhibitors.

In an embodiment, the transfer paper of the present invention is used in a transfer printing method comprising printing a design on a transfer paper with an acidic ink containing an acid dye to prepare a printed transfer paper; bringing the printed transfer paper into close contact with a nylon fabric and applying heat and pressure thereon to transfer the acid dye on the printed transfer paper to the nylon fabric; removing the printed transfer paper from the nylon fabric; and steaming the nylon fabric.

The acidic ink refers to an ink containing an acid dye as a color material. The acidic ink can be prepared by adding an acid dye, which is a color material, to any of various solvents such as water and alcohol. The acidic ink can contain, as needed, various known auxiliary agents, such as a dispersant, a resin, a penetrant, a humectant, a thickener, a pH adjuster, an antioxidant, and a reducing agent. Commercially available acidic inks can also be used.

The acid dye is registered as a color material under the name "C.I. Acid" in Color Index International and other databases. The acid dye has a $SO_3Na$ or COOH group in the molecule. Examples of the acid dye include a monoazo acid dye, a disazo acid dye, an oxazine-based acid dye, an aminoketone-based acid dye, a xanthene-based acid dye, a quinoline-based acid dye, a triphenylmethane-based acid dye, and an anthraquinone-based acid dye. Specific examples of the acid dye include dyes of various colors including yellow dyes such as C.I. Acid Yellow 1, 3, 11, 17, 18, 19, 23, 25, 36, 38, 40, 40:1, 42, 44, 49, 59, 59:1, 61, 65, 72, 73, 79, 99, 104, 110, 159, 169, 176, 184, 193, 200, 204, 207, 215, 219, 219:1, 220, 230, 232, 235, 241, 242, and 246; orange dyes such as C.I. Acid Orange 3, 7, 8, 10, 19, 24, 51, 56, 67, 74, 80, 86, 87, 88, 89, 94, 95, 107, 108, 116, 122, 127, 140, 142, 144, 149, 152, 156, 162, 166, and 168; brown dyes such as C.I. Acid Brown 2, 4, 13, 14, 19, 28, 44, 123, 224, 226, 227, 248, 282, 283, 289, 294, 297, 298, 301, 355, 357, and 413; red dyes such as C.I. Acid Red 1, 6, 8, 9, 13, 18, 27, 35, 37, 52, 54, 57, 73, 82, 88, 97, 97:1, 106, 111, 114, 118, 119, 127, 131, 138, 143, 145, 151, 183, 195, 198, 211, 215, 217, 225, 226, 249, 251, 254, 256, 257, 260, 261, 265, 266, 274, 276, 277, 289, 296, 299, 315, 318, 336, 337, 357, 359, 361, 362, 364, 366, 399, 407, and 415; violet dyes such as C.I. Acid Violet 17, 19, 21, 42, 43, 47, 48, 49, 54, 66, 78, 90, 97, 102, 109, and 126; blue dyes such as C.I. Acid Blue 1, 7, 9, 15, 23, 25, 40, 61:1, 62, 72, 74, 80, 83, 90, 92, 103, 104, 112, 113, 114, 120, 127, 127:1, 128, 129, 138, 140, 142, 156, 158, 171, 182, 185, 193, 199, 201, 203, 204, 205, 207, 209, 220, 221, 224, 225, 229, 230, 239, 249, 258, 260, 264, 277:1, 278, 279, 280, 284, 290, 296, 298, 300, 317, 324, 333, 335, 338, 342, and 350; green dyes such as C.I. Acid Green 9, 12, 16, 19, 20, 25, 27, 28, 40, 43, 56, 73, 81, 84, 104, 108, and 109; and black dyes such as C.I. Acid Black 1, 2, 3, 24, 24:1, 26, 31, 50, 52, 52:1, 58, 60, 63, 107, 109, 112, 119, 132, 140, 155, 172, 187, 188, 194, 207, and 222.

The printed transfer paper can be prepared by printing a design on a transfer paper with a dye ink. Printing is performed on the outermost coating layer side of the transfer paper. The printing method may be gravure printing, screen printing, ink jet printing, or the like. For printing a design, ink jet printing is preferable because the quality of the produced image and the flexibility of usable ink types are relatively high.

The application of heat and pressure in close contact of the printed transfer paper with the fabric means that heat and pressure are applied in a state that the printed surface of the printed transfer paper on which the design is printed is in close contact with the printing surface of the fabric. The conditions for the application of heat and pressure in close contact of the printed transfer paper with the fabric are known conditions used in a transfer printing method. For the application of heat and pressure in close contact of the printed transfer paper with the fabric, for example, a press, a heat roll, a heating drum, or the like is used for bringing the printed transfer paper into close contact with the fabric and applying heat and pressure thereon.

The removal of the printed transfer paper from the fabric means physically peeling the printed transfer paper from the fabric in close contact with the printed transfer paper. The removal method is not particularly limited and may be any known method. For example, a rolled printed transfer paper and a rolled fabric which are in close contact with each other are separately rolled up to peel the printed transfer paper.

Steaming is a treatment for fixing the dye transferred from the printed transfer paper to the fabric. Steaming is also called a wet-type fixing treatment and is a known treatment in the printing field. For steaming, a normal pressure steaming process, an HT steaming process, or an HP steaming process is typically employed. Generally, the normal pressure steaming process involves moist heat treatment at about 100° C. for 15 to 30 minutes for dye fixation to fibers; the HT steaming process involves moist heat treatment at 150 to 180° C. for 5 to 10 minutes for dye fixation to fibers; and the HP steaming process involves moist heat treatment at 120 to 135° C. for 20 to 40 minutes for dye fixation to fibers. The fabric after steaming is preferably washed with water.

The fiber which composes the fabric may be a natural fiber, a synthetic fiber, or a composite fiber thereof. Examples of the natural fiber include cellulosic fibers such as cotton, linen, lyocell, rayon, and acetate; and protein fibers such as silk, wool and other animal hairs. Examples of the synthetic fiber include polyamide (nylon), vinylon, polyester, and polyacrylic. In at least one embodiment, the fabric is a nylon fabric.

EXAMPLES

Hereinafter, the present invention will be described in more detail by examples. The present invention is not limited to the examples. In the following, "part by mass" and "% by mass" represent "part by mass" and "% by mass" in terms of dry solids content or the amount of a substantial component, respectively. The coating weight of a coating layer coating composition is expressed as dry solids content.

Base Paper

To a pulp slurry consisting of 100 parts by mass of LBKP having a freeness of 380 ml csf (measured with a Canadian standard freeness tester) , 10 parts by mass of a calcium carbonate filler, 1.2 parts by mass of amphoteric starch, 0.8 part by mass of aluminum sulfate, and 0.1 part by mass of an alkyl ketene dimer sizing agent were added and made into paper using a Fourdrinier machine. Oxidized starch was then applied on both sides of the paper at 1.5 g/m$^2$ per side using a size press, followed by machine calendering to produce a base paper having a basis weight of 50 g/m$^2$.

Substrate 1

High-density polyethylene was applied on one side of the base paper using a melt extrusion die to form a nonaqueous resin layer of 15 μm in thickness to give substrate 1 having the nonaqueous resin layer.

Substrate 2

The base paper described above was used as substrate 2.

Coating Layer Coating Composition

A coating layer coating composition was prepared by mixing the components at the ratio described below in water as a medium. The final concentration of the coating components in the coating layer coating composition was 15% by mass. Water-soluble polyester resin The number of parts is described in Tables 1 to 5.

| | |
|---|---|
| Polyvinyl alcohol resin | The type and the number of parts are described in Tables 1 to 5. |
| Acrylic resin | The type and the number of parts are described in Tables 1 to 5. |
| Starch | The number of parts is described in Tables 1 to 5. |
| Amorphous silica | The type and the number of parts are described in Tables 1 to 5. |
| Ammonium sulfate | 38 parts by mass |
| Urea | 150 parts by mass |
| Nonionic surfactant | 50 parts by mass |
| Defoamer | 15 parts by mass |

The following products were used as the materials described in Tables 1 to 5. PLAS COAT, kuraray poval, GOHSENX, Mowinyl, PENON, TOKUSIL, and FINESIL are registered trademarks.

| | |
|---|---|
| Water-soluble polyester resin: | Goo Chemical Co., Ltd.<br>PLAS COAT RZ-142 |
| Polyvinyl alcohol resin A: | Kuraray Co., Ltd.<br>kuraray poval 6-77KL<br>carboxylic acid-modified,<br>saponification degree: 74 to 80 mol % |
| Polyvinyl alcohol resin B: | Kuraray Co., Ltd.<br>kuraray poval 25-88KL<br>carboxylic acid-modified,<br>saponification degree: 85 to 90 mol % |
| Polyvinyl alcohol resin C: | Kuraray Co., Ltd.<br>kuraray poval 32-97KL<br>carboxylic acid-modified,<br>saponification degree: 95 to 99 mol % |
| Polyvinyl alcohol resin D: | Mitsubishi Chemical Corporation<br>GOHSENX T-350<br>carboxylic acid-modified,<br>saponification degree: 93 to 95 mol % |
| Polyvinyl alcohol resin E: | Kuraray Co., Ltd.<br>kuraray poval 22-88<br>saponification degree: 87 to 89 mol % |
| Acrylic resin A: | Japan Coating Resin Co., Ltd.<br>Mowinyl 731A<br>Tg = 0° C./MFT = 0° C. |
| Acrylic resin B: | Japan Coating Resin Co., Ltd.<br>Mowinyl 727<br>Tg = 5° C./MFT = 25° C. |
| Acrylic resin C: | Japan Coating Resin Co., Ltd.<br>Mowinyl 6520<br>Tg = 41° C./MFT = 50° C. |
| Acrylic resin D: | Japan Coating Resin Co., Ltd.<br>Mowinyl 718A<br>Tg = −6° C./MFT = 0° C. |
| Acrylic resin E: | Japan Coating Resin Co., Ltd.<br>Mowinyl 742A<br>Tg = 45° C./MFT = 53° C. |
| Starch: | Hydroxyalkyl starch<br>Nippon Starch Chemical Co., Ltd.<br>PENON JE-66 |
| Amorphous silica A: | OSC<br>TOKUSIL GU-N<br>average particle diameter: 17.8 μm |
| Amorphous silica B: | OSC<br>TOKUSIL NP<br>average particle diameter: 10.3 μm |
| Amorphous silica C: | OSC<br>FINESIL X60<br>average particle diameter: 6.6 μm |
| Amorphous silica D: | Mizusawa Industrial Chemicals, Ltd.<br>MIZUKASIL P78F<br>average particle diameter: 19 μm |
| Amorphous silica E: | TOYOTAKAKO Co., Ltd.<br>silica gel A white under 200 mesh<br>average particle diameter: 47 μm |

TABLE 1

| | Outermost coating layer | | | | |
|---|---|---|---|---|---|
| | Material | Part by mass | Substrate | Evaluation of removability | Evaluation of design |
| Example 1 | Water-soluble polyester resin | 25 | Substrate 1 | B | B |
| | Polyvinyl alcohol resin B | 100 | | | |
| | Acrylic resin A | 50 | | | |
| | Starch | 150 | | | |
| | Amorphous silica A | 30 | | | |

TABLE 1-continued

| | Outermost coating layer | | | | |
|---|---|---|---|---|---|
| | Material | Part by mass | Substrate | Evaluation of removability | Evaluation of design |
| Example 2 | Water-soluble polyester resin | 25 | Substrate 1 | A | B |
| | Polyvinyl alcohol resin B | 100 | | | |
| | Acrylic resin B | 50 | | | |
| | Starch | 150 | | | |
| | Amorphous silica A | 30 | | | |
| Example 3 | Water-soluble polyester resin | 25 | Substrate 1 | B | B |
| | Polyvinyl alcohol resin B | 100 | | | |
| | Acrylic resin C | 50 | | | |
| | Starch | 150 | | | |
| | Amorphous silica A | 30 | | | |
| Example 4 | Water-soluble polyester resin | 50 | Substrate 1 | A | A |
| | Polyvinyl alcohol resin B | 100 | | | |
| | Acrylic resin B | 50 | | | |
| | Starch | 150 | | | |
| | Amorphous silica A | 30 | | | |
| Example 5 | Water-soluble polyester resin | 75 | Substrate 1 | B | A |
| | Polyvinyl alcohol resin B | 100 | | | |
| | Acrylic resin B | 50 | | | |
| | Starch | 150 | | | |
| | Amorphous silica A | 30 | | | |
| Example 6 | Water-soluble polyester resin | 50 | Substrate 1 | A | B |
| | Polyvinyl alcohol resin B | 100 | | | |
| | Acrylic resin B | 25 | | | |
| | Starch | 150 | | | |
| | Amorphous silica A | 30 | | | |

TABLE 2

| | Outermost coating layer | | | | |
|---|---|---|---|---|---|
| | Material | Part by mass | Substrate | Evaluation of removability | Evaluation of design |
| Example 7 | Water-soluble polyester resin | 50 | Substrate 1 | B | A |
| | Polyvinyl alcohol resin B | 100 | | | |
| | Acrylic resin B | 75 | | | |
| | Starch | 150 | | | |
| | Amorphous silica A | 30 | | | |
| Example 8 | Water-soluble polyester resin | 50 | Substrate 1 | B | A |
| | Polyvinyl alcohol resin B | 100 | | | |
| | Acrylic resin B | 50 | | | |
| | Starch | 100 | | | |
| | Amorphous silica A | 30 | | | |
| Example 9 | Water-soluble polyester resin | 50 | Substrate 1 | A | B |
| | Polyvinyl alcohol resin B | 100 | | | |
| | Acrylic resin B | 50 | | | |
| | Starch | 200 | | | |
| | Amorphous silica A | 30 | | | |
| Example 10 | Water-soluble polyester resin | 50 | Substrate 1 | B | B |
| | Polyvinyl alcohol resin B | 100 | | | |
| | Acrylic resin B | 50 | | | |
| | Starch | 150 | | | |
| | Amorphous silica A | 15 | | | |
| Example 11 | Water-soluble polyester resin | 50 | Substrate 1 | A | C |
| | Polyvinyl alcohol resin B | 100 | | | |
| | Acrylic resin B | 50 | | | |
| | Starch | 150 | | | |
| | Amorphous silica A | 40 | | | |
| Example 12 | Water-soluble polyester resin | 50 | Substrate 1 | A | C |
| | Polyvinyl alcohol resin A | 100 | | | |
| | Acrylic resin B | 50 | | | |
| | Starch | 150 | | | |
| | Amorphous silica A | 30 | | | |

TABLE 3

| | Outermost coating layer | | | | |
|---|---|---|---|---|---|
| | Material | Part by mass | Substrate | Evaluation of removability | Evaluation of design |
| Example 13 | Water-soluble polyester resin | 50 | Substrate 1 | C | B |
| | Polyvinyl alcohol resin C | 100 | | | |
| | Acrylic resin B | 50 | | | |
| | Starch | 150 | | | |
| | Amorphous silica A | 30 | | | |
| Example 14 | Water-soluble polyester resin | 50 | Substrate 1 | B | B |
| | Polyvinyl alcohol resin D | 100 | | | |
| | Acrylic resin B | 50 | | | |
| | Starch | 150 | | | |
| | Amorphous silica A | 30 | | | |
| Example 15 | Water-soluble polyester resin | 50 | Substrate 1 | B | B |
| | Polyvinyl alcohol resin D | 100 | | | |
| | Acrylic resin B | 50 | | | |
| | Starch | 150 | | | |
| | Amorphous silica B | 30 | | | |
| Example 16 | Water-soluble polyester resin | 50 | Substrate 1 | C | C |
| | Polyvinyl alcohol resin D | 100 | | | |
| | Acrylic resin B | 50 | | | |
| | Starch | 150 | | | |
| | Amorphous silica C | 30 | | | |

TABLE 4

| | Outermost coating layer | | Amorphous silica | | | Evaluation | |
|---|---|---|---|---|---|---|---|
| | Material | Part by mass | μm | D80/D20 | Substrate | of removability | Evaluation of design |
| Example 17 | Water-soluble polyester resin | 50 | 19 | 2.8 | Substrate 1 | C | B |
| | Polyvinyl alcohol resin C | 100 | | | | | |
| | Acrylic resin B | 50 | | | | | |
| | Starch | 150 | | | | | |
| | Amorphous silica D | 30 | | | | | |
| | Amorphous silica E | 0 | | | | | |
| Example 18 | Water-soluble polyester resin | 50 | 22 | 2.5 | Substrate 1 | C | B |
| | Polyvinyl alcohol resin C | 100 | | | | | |
| | Acrylic resin B | 50 | | | | | |
| | Starch | 150 | | | | | |
| | Amorphous silica A | 27 | | | | | |
| | Amorphous silica E | 3 | | | | | |
| Example 19 | Water-soluble polyester resin | 50 | 27 | 3.2 | Substrate 1 | A | A |
| | Polyvinyl alcohol resin C | 100 | | | | | |
| | Acrylic resin B | 50 | | | | | |
| | Starch | 150 | | | | | |
| | Amorphous silica A | 15 | | | | | |
| | Amorphous silica E | 15 | | | | | |
| Example 20 | Water-soluble polyester resin | 50 | 37 | 4.3 | Substrate 1 | A | B |
| | Polyvinyl alcohol resin C | 100 | | | | | |
| | Acrylic resin B | 50 | | | | | |
| | Starch | 150 | | | | | |
| | Amorphous silica A | 3 | | | | | |
| | Amorphous silica E | 27 | | | | | |

TABLE 4-continued

| | Outermost coating layer | | Amorphous silica | | | Evaluation | |
|---|---|---|---|---|---|---|---|
| | Material | Part by mass | μm | D80/D20 | Substrate | of removability | Evaluation of design |
| Example 21 | Water-soluble polyester resin | 50 | 41 | 4.6 | Substrate 1 | C | B |
| | Polyvinyl alcohol resin C | 100 | | | | | |
| | Acrylic resin B | 50 | | | | | |
| | Starch | 150 | | | | | |
| | Amorphous silica D | 3 | | | | | |
| | Amorphous silica E | 27 | | | | | |
| Example 22 | Water-soluble polyester resin | 50 | 31 | 5.5 | Substrate 1 | B | B |
| | Polyvinyl alcohol resin C | 100 | | | | | |
| | Acrylic resin B | 50 | | | | | |
| | Starch | 150 | | | | | |
| | Amorphous silica C | 7.5 | | | | | |
| | Amorphous silica E | 22.5 | | | | | |
| Example 23 | Water-soluble polyester resin | 50 | 31 | 3.4 | Substrate 1 | B | A |
| | Polyvinyl alcohol resin C | 100 | | | | | |
| | Acrylic resin B | 50 | | | | | |
| | Starch | 150 | | | | | |
| | Amorphous silica D | 15 | | | | | |
| | Amorphous silica E | 15 | | | | | |

TABLE 5

| | Outermost coating layer | | | | |
|---|---|---|---|---|---|
| | Material | Part by mass | Substrate | Evaluation of removability | Evaluation of design |
| Comparative Example 1 | Water-soluble polyester resin | 50 | Substrate 1 | D | B |
| | Polyvinyl alcohol resin B | 100 | | | |
| | Acrylic resin D | 50 | | | |
| | Starch | 150 | | | |
| | Amorphous silica A | 30 | | | |
| Comparative Example 2 | Water-soluble polyester resin | 50 | Substrate 1 | D | C |
| | Polyvinyl alcohol resin B | 100 | | | |
| | Acrylic resin E | 50 | | | |
| | Starch | 150 | | | |
| | Amorphous silica A | 30 | | | |
| Comparative Example 3 | Water-soluble polyester resin | 50 | Substrate 1 | D | C |
| | Polyvinyl alcohol resin E | 100 | | | |
| | Acrylic resin B | 50 | | | |
| | Starch | 150 | | | |
| | Amorphous silica A | 15 | | | |
| Comparative Example 4 | Water-soluble polyester resin | 50 | Substrate 2 | D | D |
| | Polyvinyl alcohol resin B | 100 | | | |
| | Acrylic resin B | 50 | | | |
| | Starch | 150 | | | |
| | Amorphous silica A | 30 | | | |
| Comparative Example 5 | Water-soluble polyester resin | 0 | Substrate 1 | C | D |
| | Polyvinyl alcohol resin B | 100 | | | |
| | Acrylic resin B | 50 | | | |
| | Starch | 200 | | | |
| | Amorphous silica A | 30 | | | |
| Comparative Example 6 | Water-soluble polyester resin | 75 | Substrate 1 | E | D |
| | Polyvinyl alcohol resin B | 0 | | | |
| | Acrylic resin B | 75 | | | |
| | Starch | 200 | | | |
| | Amorphous silica A | 30 | | | |

TABLE 5-continued

| | Outermost coating layer | | | | |
|---|---|---|---|---|---|
| | Material | Part by mass | Substrate | Evaluation of removability | Evaluation of design |
| Comparative Example 7 | Water-soluble polyester resin | 50 | Substrate 1 | C | D |
| | Polyvinyl alcohol resin B | 100 | | | |
| | Acrylic resin B | 0 | | | |
| | Starch | 200 | | | |
| | Amorphous silica A | 30 | | | |
| Comparative Example 8 | Water-soluble polyester resin | 75 | Substrate 1 | E | D |
| | Polyvinyl alcohol resin B | 200 | | | |
| | Acrylic resin B | 75 | | | |
| | Starch | 0 | | | |
| | Amorphous silica A | 30 | | | |
| Comparative Example 9 | Water-soluble polyester resin | 50 | Substrate 1 | D | C |
| | Polyvinyl alcohol resin B | 100 | | | |
| | Acrylic resin B | 50 | | | |
| | Starch | 150 | | | |
| | Amorphous silica A | 0 | | | |

Transfer Paper

The coating layer coating composition was applied on one side of the substrate using an air-knife coater and dried using a hot air dryer to form the outermost coating layer. Finally, the produced paper was taken up into a roll to obtain a rolled transfer paper. The coating weight was 20 g/m$^2$. When substrate 1 was used, coating and drying were performed on the nonaqueous resin layer side of the substrate.

Printed Transfer Paper

A test design was printed on the outermost coating layer side of the rolled transfer paper with acidic inks containing acid dyes (cyan, magenta, yellow, black) using an inkjet printer (VJ-1628TD, manufactured by MUTOH INDUSTRIES, Ltd.) equipped with the acidic inks containing acid dyes, to give a rolled printed transfer paper. The acidic inks containing acid dyes used were EA inks manufactured by KIWA Chemical Industry Co., Ltd.

Transfer Printing

Unpretreated nylon fabric was used as a fabric. The printed transfer paper and the nylon fabric were fed such that the printed surface of the printed transfer paper faced the printing surface of the nylon fabric, and through a roll-nip system equipped with a heating drum, the printed transfer paper and the nylon fabric were brought into close contact with each other, and heat and pressure were applied thereon. The conditions for the application of heat and pressure were as follows: the temperature was 120° C., the linear pressure was 70 kg/cm, and the duration was 0.5 second.

Removal of Printed Transfer Paper

The printed transfer paper and the nylon fabric stuck to the printed transfer paper were separately rolled up to peel off the printed transfer paper from the nylon fabric.

Evaluation of Removability

The removal of the printed transfer paper from the nylon fabric was visually observed and evaluated according to the criteria shown below. The results are shown in Tables 1 to 5. In the present invention, when the grade was any of A to C, the printed transfer paper was regarded as practically removable from the nylon fabric.

A: Removal can be achieved smoothly.

B: Removal can be achieved but requires a stronger pull in comparison with grade A.

C: Removal can be achieved but requires a reduced speed in comparison with grade B.

D: A further reduced speed is required in comparison with grade C, and removal can be achieved at too slow a speed. This grade is unfavorable from the viewpoint of productivity.

E: The printed transfer paper is torn and difficult to remove.

Steaming of Nylon Fabric

While the rolled nylon fabric separated from the printed transfer paper was fed from an unwinder to a winder, the rolled nylon fabric was subjected to moist heat treatment at 100 to 105° C. for 20 to 30 minutes by a normal pressure steaming process.

Water Washing

After steaming, the nylon fabric was subjected to water washing, water washing at ordinary temperature, water washing at 50° C., and water washing at ordinary temperature in this order.

Evaluation of Design

The design formed on the nylon fabric was visually evaluated in terms of partial missing, color unevenness, and color-development deterioration according to the criteria shown below. The results are shown in Tables 1 to 5. In the present invention, when the grade was any of A to C, the transfer paper was regarded as unlikely to cause problems such as partial missing, color unevenness, color-development deterioration, etc. of the design on the nylon fabric.

A: Partial missing, color unevenness, and color-development deterioration are not observed, and the quality of the design is good.

B: Partial missing, color unevenness, and/or color-development deterioration are slightly observed but the quality of the design is generally good.

C: Partial missing, color unevenness, and/or color-development deterioration are observed, and the quality of the design is poor in comparison with grade B but practically acceptable.

D: Partial missing, color unevenness, and/or color-development deterioration are observed, and the quality of the design is poor in comparison with grade C and unacceptable.

As is clear from Tables 1 to 5, any of Examples 1 to 23, which had the constituent features of the present invention, was practically satisfactory in the removability of the printed transfer paper from the nylon fabric before steaming and was unlikely to cause problems such as partial missing, color unevenness, color-development deterioration, etc. of the design on the nylon fabric.

In contrast, Comparative Examples 1 to 9, which lacked any of the constituent features of the present invention, had unsatisfactory results in the evaluation of removability and/or the evaluation of the design. More specifically, Comparative Example 1, which had a low glass transition point (-6° C.) of the acrylic resin of the outermost coating layer, was unsatisfactory in the removability of the printed transfer paper; Comparative Example 2, which had a high minimum film forming temperature (53° C.) of the acrylic resin of the outermost coating layer, was unsatisfactory in the removability of the printed transfer paper; Comparative Example 3, which did not use a carboxylic acid-modified polyvinyl alcohol resin as the polyvinyl alcohol resin in the outermost coating layer, was unsatisfactory in the removability of the printed transfer paper; Comparative Example 4, which had no nonaqueous resin layer on the base paper, had unsatisfactory results in both the evaluation of the removability of the printed transfer paper and the evaluation of the design; Comparative Example 5, which had no water-soluble polyester resin in the outermost coating layer, had unsatisfactory results in the evaluation of the design; Comparative Example 6, which had no carboxylic acid-modified polyvinyl alcohol resin in the outermost coating layer, had unsatisfactory results in both the evaluation of the removability of the printed transfer paper and the evaluation of the design; Comparative Example 7, which had no acrylic resin in the outermost coating layer, had unsatisfactory results in the evaluation of the design; Comparative Example 8, which had no starch in the outermost coating layer, had unsatisfactory results in both the evaluation of the removability of the printed transfer paper and the evaluation of the design; and Comparative Example 9, which had no white pigment in the outermost coating layer, was unsatisfactory in the removability of the printed transfer paper.

As is shown in Table 4, a preferable case is where the white pigment at least comprises an amorphous silica; and the amorphous silica has a volume-based average particle diameter of 27 μm to 40 μm as determined by laser diffraction/scattering particle size distribution measurement.

Also shown in Table 4 is that a preferable case is where the amorphous silica has a ratio D80 of D20 (D80/D20) of 2.9 to 4.5 as determined by laser diffraction/scattering particle size distribution measurement. As defined above, D20 represents a particle diameter at a cumulative frequency of 20% from a starting point where a particle diameter is zero in a volume-based particle size distribution curve which plots the diameter of particles on the horizontal axis and the frequency of particles on the vertical axis, and D80 represents a particle diameter at a cumulative frequency of 80% from a starting point where a particle diameter is zero in the volume-based particle size distribution curve which plots the diameter of particles on the horizontal axis and the frequency of particles on the vertical axis.

The invention claimed is:

1. A transfer paper which is adapted for use in a transfer printing method comprising printing the design on the transfer paper with a dye ink to prepare a printed transfer paper, bringing the printed transfer paper into close contact with a fabric and applying heat and pressure thereon to transfer the dye from the printed transfer paper to the fabric, removing the printed transfer paper from the fabric, and steaming the fabric, the transfer paper comprising:

a substrate comprising a base paper and one or more nonaqueous resin layers on one side of the base paper, said nonaqueous resin layers containing only nonaqueous resin without any light-heat converting substance; and one or more coating layers located on the one or more nonaqueous resin layers, the outermost coating layer comprising a water-soluble polyester resin, a carboxylic acid-modified polyvinyl alcohol resin, an acrylic resin, a starch and a white pigment, wherein the acrylic resin has a glass transition point of 0 to 45° C. and a minimum film forming temperature of 0 to 50° C.

2. The transfer paper according to claim 1, wherein the white pigment comprises an amorphous silica having a volume-based average particle diameter of 27 to 40 μm as determined by laser diffraction/scattering particle size distribution measurement.

3. The transfer paper according to claim 2, wherein the amorphous silica has a D80/D20 ratio of 2.9 to 4.5 as determined by laser diffraction/scattering particle size distribution measurement, where D20 and D80 respectively represent a particle diameter at a cumulative frequency of 20% and 80% from a starting point where a particle diameter is zero in a volume-based particle size distribution curve that plots the diameter of particles on the horizontal axis and the frequency of particles on the vertical axis.

4. The transfer paper according to claim 1, wherein the transfer paper has not been subjected to printing.

5. The transfer paper according to claim 2, wherein the transfer paper has not been subjected to printing.

6. The transfer paper according to claim 3, wherein the transfer paper has not been subjected to printing.

* * * * *